US005312103A

United States Patent [19]

Chateau

[11] Patent Number: 5,312,103

[45] Date of Patent: May 17, 1994

[54] APPARATUS FOR ARBITRARY DRAWING OF PLANAR OBJECTS

[76] Inventor: Clotaire R. G. Chateau, 8, Allée des Sapins, 94420 Le Plessis Trevise, France

[21] Appl. No.: 19,433

[22] Filed: Feb. 18, 1993

[30] Foreign Application Priority Data

Feb. 20, 1992 [FR] France ..... 92 01917

[51] Int. Cl.[5] ..... A63B 71/00; A63F 1/18

[52] U.S. Cl. ..... 273/144 A; 273/144 B; 273/144 R

[58] Field of Search ..... 273/149 R, 144 A, 144 B, 273/144 R

[56] References Cited

U.S. PATENT DOCUMENTS

| | | | |
|---|---|---|---|
| 2,657,059 | 10/1953 | Selig | 273/144 R |
| 2,696,385 | 12/1954 | Hadfield et al. | 273/149 R |
| 2,731,268 | 1/1956 | Raizen . | |
| 2,792,227 | 5/1957 | Auerbach | 273/144 A |
| 2,889,961 | 6/1959 | Belmonte | 273/144 R |
| 4,732,387 | 3/1988 | Elinski | 273/144 A |
| 4,786,056 | 11/1988 | Dunningan | 273/144 A |
| 4,813,676 | 3/1989 | Weatherspoon | 273/144 A |
| 5,050,880 | 9/1991 | Sloan | 273/144 B |
| 5,125,659 | 6/1992 | Garbee | 273/144 A |

FOREIGN PATENT DOCUMENTS

| | | |
|---|---|---|
| 0348281 | 12/1989 | European Pat. Off. . |
| 1225047 | 6/1960 | France . |
| 1287054 | 7/1962 | France . |
| 84-00115 | 1/1984 | World Int. Prop. O. . |

*Primary Examiner*—Gene Mancene
*Assistant Examiner*—Cindy A. Cherichetti
*Attorney, Agent, or Firm*—Sandler, Greenblum & Bernstein

[57] ABSTRACT

Apparatus and process are provided for arbitrary drawing of planar objects wherein an air current is created in a receptacle, and planar objects, having two opposing faces each having the reproduction of a picture, are introduced into the receptacle. The apparatus includes elements for capturing a planar object in an arbitrary manner, and the captured planar object can be extracted from the receptacle. The receptacle has, on its portion located toward the front, a groove having a trapezoidal section whose width decreases from its upper portion to its lower portion. The base of the groove extends, at its lower portion, beyond the outer surface of the receptacle so as to define a space which is adequate to enable passage of a planar object. The space is blocked by a retractable bar forming the base of the groove for engaging the planar object.

22 Claims, 3 Drawing Sheets

APPARATUS FOR ARBITRARY DRAWING OF PLANAR OBJECTS

BACKGROUND OF THE INVENTION

1. Field of the Invention

The present invention is related to a device for the arbitrary drawing of planar objects containing figures thereon, such as those represented on playing cards.

2. Background and Material Information

Apparatus that enable the arbitrary drawing of balls are known in the art. One such apparatus is described in European patent application No. 0 348 281, the disclosure of which is hereby incorporated by reference in its entirety.

This apparatus comprises a spherical receptacle in which the balls are maintained in movement by a carefully oriented air current. To undertake the drawing, the apparatus also comprises a tube capable of crossing the spherical receptacle and wherein a depression can be created so as to suction the ball, which passes in the vicinity of the upper opening of the tube, and of maintains it on the end.

Such a machine is satisfactory and proves that an air current is an appropriate means to agitate and mix objects.

However, a machine of this type does not enable agitation of flat objects such as playing cards, because the air current presses the objects against the wall of the receptacle.

In other words, known machines are not appropriate for pictures or other similar planar objects.

Certainly one could reproduce the pictures on balls and use existing machines, but the visual effect obtained would not be very attractive.

SUMMARY OF THE INVENTION

The device of the invention comprises two elements: a machine comprising a spherical receptacle in which an air current can be created, and planar objects that are introduced into the receptacle. Each planar object comprises, on two of its opposing faces, the reproduction of a picture. Means are provided to capture a planar object in an arbitrary manner in order to remove the planar object from the receptacle.

The transparent spherical receptacle has, in its portion located in the front, a groove having a trapezoidal section, whose base is offset towards the outside and narrows progressively from its upper end to its lower end to extend beyond the outer surface of the spherical receptacle so as to arrange adequate space enabling passage of a planar object.

Air is sent into the sphere so as to create an air current which produces a movement extending from the rear to the front. When the planar objects are introduced in the sphere and agitated by the air current, all the planar objects are displaced along a circular trajectory that is comprised substantially in the vertical symmetrical plane of the groove.

In other words, it is an object of the present invention to provide an apparatus for arbitrary drawing of planar objects comprising a receptacle in which an air current can be created; means for introducing planar objects into the receptacle, the planar objects comprising two opposite faces each having a reproduction of a picture; means for capturing a planar object in an arbitrary manner; and means for extracting a captured planar object from the receptacle.

Preferably, the receptacle comprises, on a front portion, a first groove having a trapezoidal section whose width decreases from an upper portion to a lower portion. The lower portion of the first groove can extend beyond an outer surface of the receptacle to define a space for passage of a planar object. The apparatus can also comprise a second groove having a base and a retractable bar, and space can be blocked by the retractable bar to form the base of the second groove in which the lower portion of a planar object can be engaged.

According to another aspect of the invention, the apparatus comprises means for delaying the drawing; means for protecting the captured planar object; means for detecting the presence of a planar object in the second groove and means for controlling the placement of the means for protecting the captured planar object.

According to a preferred aspect of the invention, the means for delaying the drawing comprise a retractable bar displacable so as to block the second groove and the means for protecting the captured planar object comprise at least one finger capable of projecting into the first groove, when a planar object is captured, to avoid it from being hit by other planar objects moving in the receptacle. A rotatable shaft can be located outside the receptacle to carry the at least one finger, with rotation of the shaft being capable of making the at least one finger project into the first groove through at least one slot. The receptacle comprises an opening at a lower portion, and the apparatus further comprises a base, supporting the receptacle, having a curved, central portion partially penetrating into the receptacle, the central portion having a periphery including an opening for flow of air.

According to still another aspect of the invention, the apparatus comprises means for stopping flow of air current following detection of a planar object in the second groove; the receptacle is spherically shaped; the means for introducing planar objects into the receptacle comprises a plurality of substantially vertical grooves; the means for introducing planar objects into the receptacle further comprises a retractable trap and the apparatus further comprises a plurality of planar objects.

It is also an object of the invention to provide a method for arbitrary drawing of planar objects comprising placing a plurality of planar objects into a receptacle, producing an air current in the receptacle to move the planar objects within the receptacle, capturing a planar object in a groove in the receptacle and removing the captured planar object from the receptacle.

According to further embodiments of the process of the present invention, the air current can be stopped after a planar object is captured, the captured planar object can be protected by projecting at least one finger into the receptacle above the captured planar object to avoid the captured planar object from being hit by other planar objects moving in the receptacle, and the capture of a planar object can be delayed by displacing a retractable bar to block the groove to prevent capturing the planar object.

According to a further embodiment of the invention, each planar object has the shape of a pallet, and comprises a picture on each of its surfaces.

BRIEF DESCRIPTION OF THE DRAWINGS

Other characteristics of the invention will become more apparent upon reading the description that follows with reference to the annexed drawings, provided as non-limiting examples, in which.

DETAILED DESCRIPTION OF THE PREFERRED EMBODIMENTS

Figure 2:
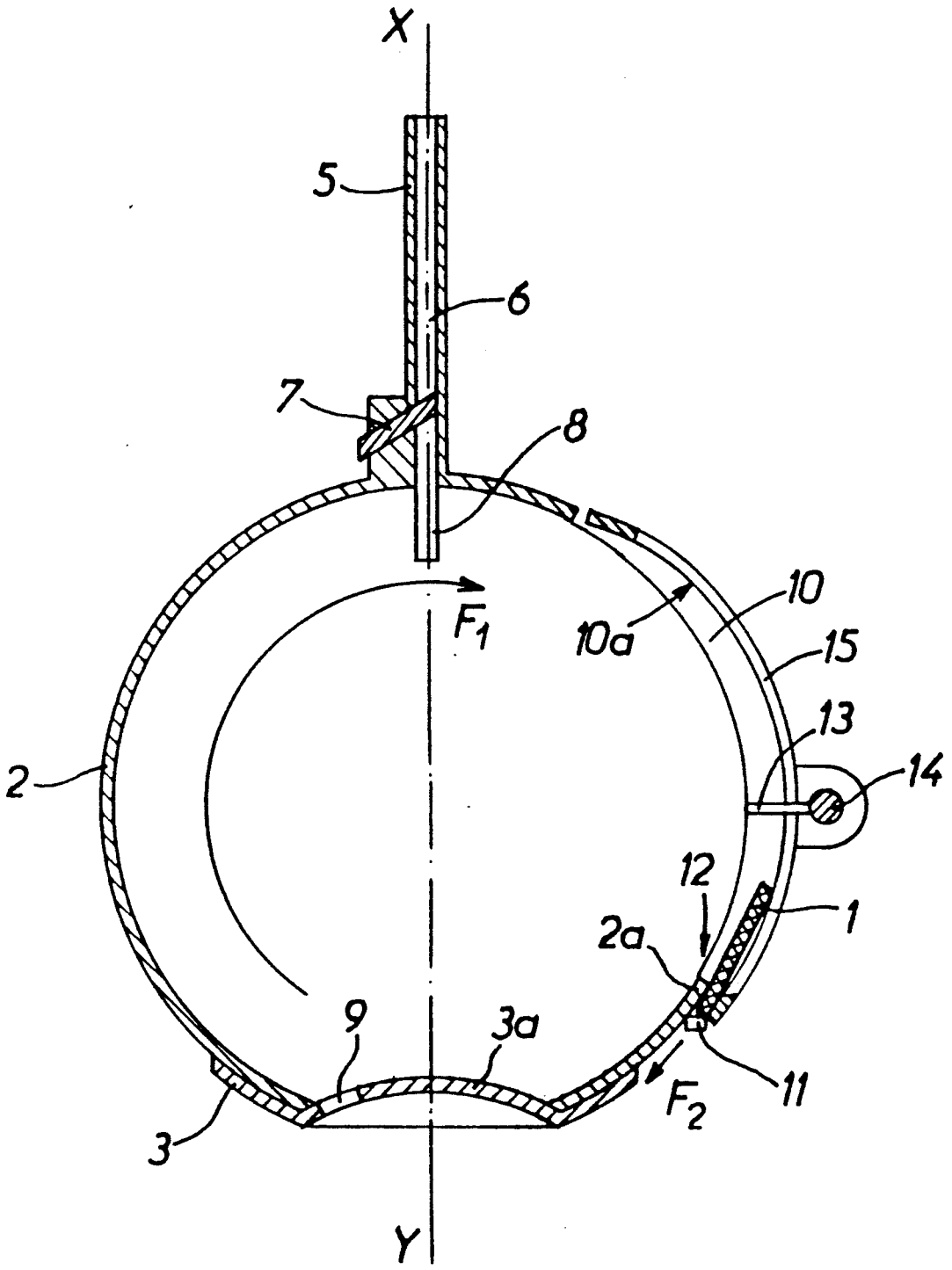
FIG. 2 is a sectional view along line II—II of FIG. 1.
Figure 3:
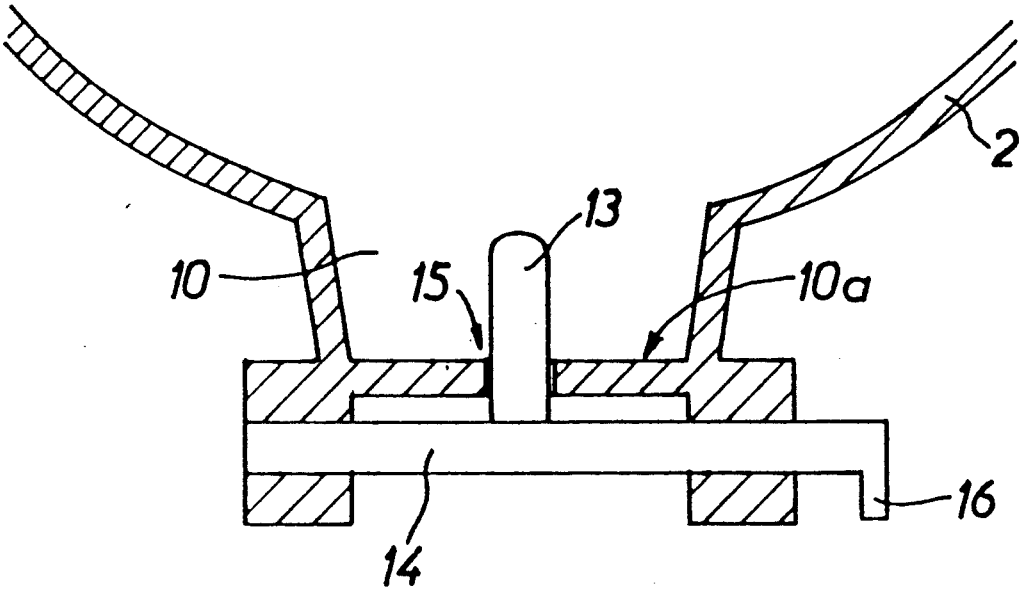
FIG. 3 is a sectional view, limited to the section and at a larger scale, along line III—III of FIG. 1.

With reference to FIG. 2, the portion of the machine which is located to the right of axis XY forms the front portion and the portion which is located to the left of the axis forms the rear portion.

In an embodiment of the invention using playing cards, each card from the set of cards is reproduced on the front and rear surfaces of a flattened planar object, or pallet, such as illustrated by reference numeral 1 in FIGS. 1 and 2. In light of the normal dimensions of a playing card, which are reproduced in a natural scale, the thickness of each pallet is of the order of a few millimeters. Apart from the impressions, all the pallets are strictly identical in dimension and in density.

Pallets 1 are introduced in a spherical receptacle 2 whose lower portion, which is open, rests on base 3 affixed to a frame illustrated by reference numeral 4 in FIG. 1. Means are provided to fix receptacle 2 on base 3. Thus, for example, one can use a quick assembly means of a known type, such as a bayonet socket means, whereby the assembly is obtained by an axial displacement of the sphere, followed by a rotation along such axis.

According to an embodiment, sphere 2 can have an overlying loader 5 comprising a plurality of vertical grooves 6 in which planar objects 1 are engaged and visible. Grooves 6 communicate, by means of a retractable trap 7, with receptacle 2 which has, a slot 8. By activating trap 7, by any known means, all the pallets required for the drawing fall into receptacle 2.

Base 3 has an opening 9 by which the air that circulates in sphere 2 is sent along a direction which is substantially that of the curvilinear arrow F1. Influenced by this air current, all the pallets are substantially driven along the same direction.

Figure 4:
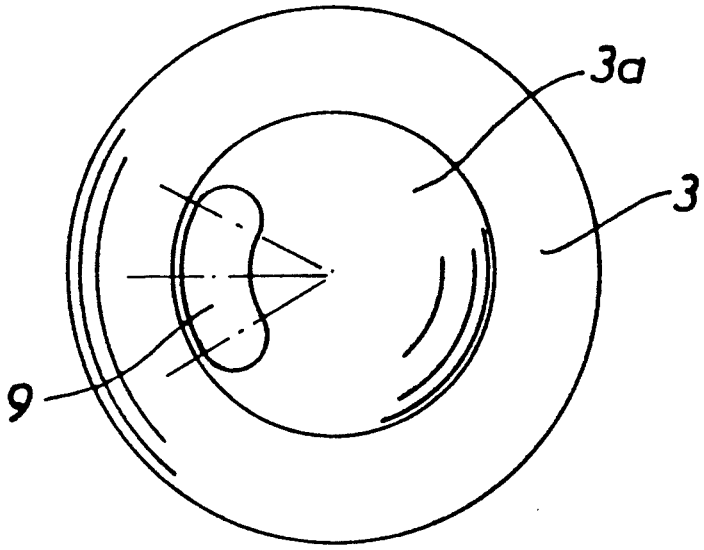
FIG. 4 is the top view of the lower portion of the receptacle.

The air jet can be controlled by pivoting flaps, similar to those described in European patent application No. 0 348 281, and whose axes appear in dotted and dashed lines in FIG. 4.

According to an important characteristic of the invention, the central portion **3*a* of base 3 is curved in such a way that it partially penetrates into sphere 2 and opening 9** is located at the periphery of the portion and towards the rear. In this way, the pallets are deviated and do not run the risk of hitting the rear edge of the opening which could damage them.

The front portion of the sphere has a groove 10 whose base **10*a* is offset towards the outside. Groove 10 has a trapezoidal section and its width reduces from its upper portion to its lower portion. At the lower portion of the groove, base 10*a* partially covers portion 2*a* of sphere 2** while at the same time providing adequate space for passage of a pallet.

The lower end of groove 10 is normally blocked by a mobile bar 11 so as to form a groove 12 in which the lower portion of the pallet penetrates.

Under the effect of the air current, the pallets can penetrate into groove 10, slide along base **10*a* and one of the pallets can get inserted in the space between portion 2*a* and the base of the groove by taking support against bar 11 (position shown in FIG. 2**).

Figure 1:
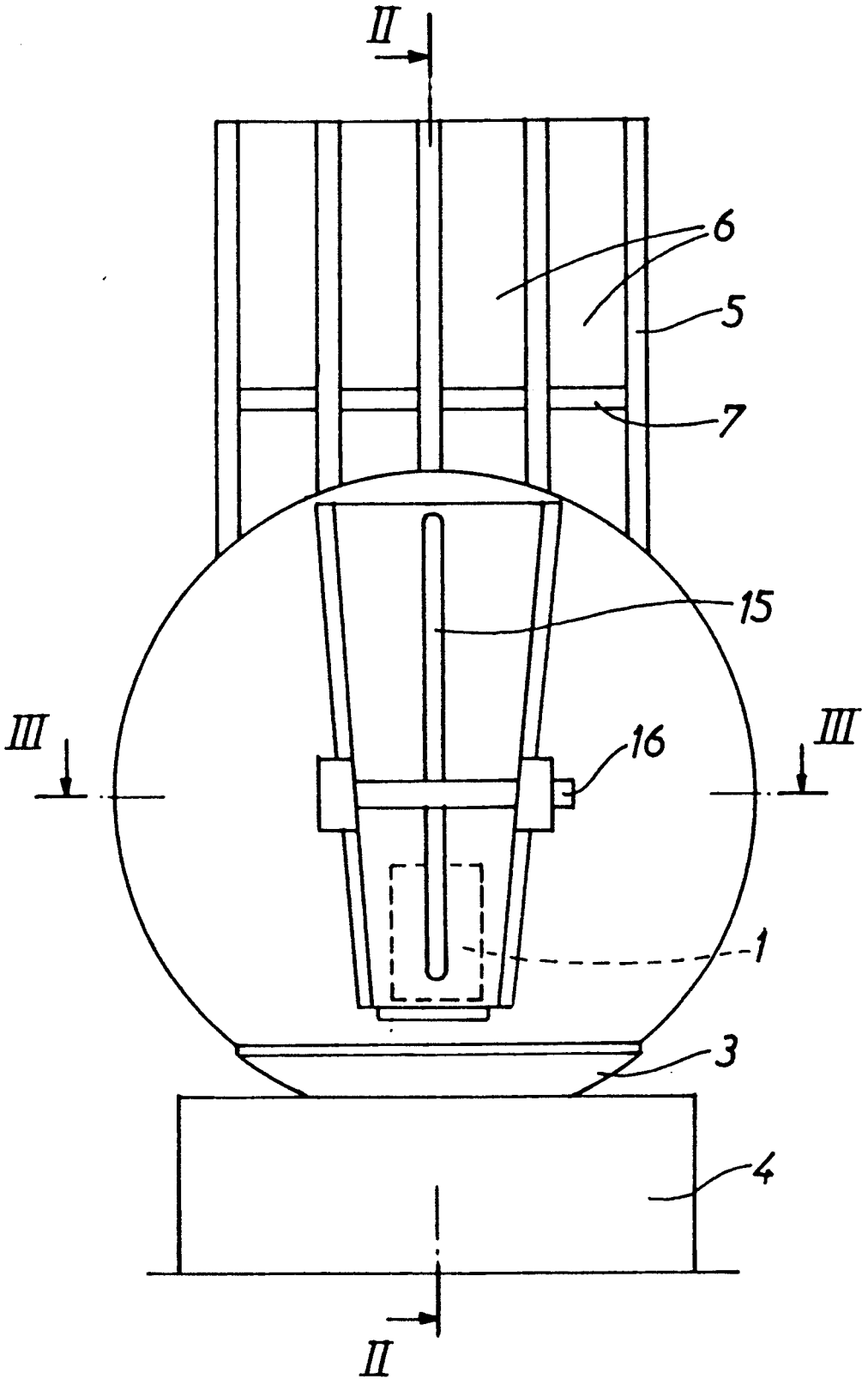
FIG. 1 is a top view of the machine.

The width of groove 10, at its lower portion, is such that only pallets that are present in the right position, the one shown in FIG. 1, can be captured, the others being deviated by means of oblique flaps of the groove and sent back towards the center of the sphere. From this above-cited position, one need only retract bar 11 to evacuate the pallet by means of an appropriate non-represented chute. In fact, the problem is more complicated because one notes that the "capture" of a pallet occurs too quickly for the spectators to take part in the agitation of the pallet. In addition, it has been noted that when a pallet comes into groove 12, it can be driven away from it by another.

According to the invention, means are provided to slow the capture of a pallet and to protect the captured pallet.

To protect the captured pallet, one uses a first means, which detects the presence of a pallet in groove 12 and a second means, depending on the first, that isolates the captured pallet.

Different means can be used to detect the presence of a pallet. Preferably, one uses a fiber optic device housed in bar 11. A first optical fiber sends out a light beam, a portion of which is reflected towards the end of a second optical fiber when a pallet enters groove 12, thus creating a signal which is used to control the placement of the protection member. The entire operation is quasi-instantaneous and takes place in a time which is less than 1/1,000 of a second.

According to an embodiment, the protection member comprises fingers 13 capable of extending into groove 10. These fingers are carried by a shaft 14 located outside the groove whose base has slots 15 for passage of the fingers. To simplify the drawings, a single slot 15 is shown in FIG. 1. As regards slots 15, it must be specified that these are determined so as to provide an appropriate section to the air that must leave sphere 2.

Fingers 13 are used to slow the drawing. They extend naturally into groove 10 as per the position shown in FIG. 2.

To undertake the drawing, fingers 13 are retracted and no longer project from the base of groove 12.

When the presence of a pallet in groove 12 is noted, the pivoting of shaft 14 is controlled in order to place fingers 13 in the position represented in FIG. 2. In this position, the end of the fingers is radial to the extension of the internal surface of the sphere. The pallets which are in movement hit against the fingers and are thus sent back towards the center of the sphere without being able to reach the captured pallet.

The control of the rotation of shaft 14 is by the displacement of a mobile electromagnetic frame of the type having a solenoid plunger, whose rod can act on the lateral extension 16 of shaft 14.

The retraction control of bar 11 is by displacing it parallel to itself along the direction of arrow F2. This displacement does not pose any technical problem.

According to an embodiment, one could envision an equivalent device which does not use fingers 13.

According to this embodiment, when one wishes to delay the drawing, bar 11 is displaced in parallel to itself and upwardly so as to place it in a position wherein the groove is totally blocked. In this position, it is therefore not possible to capture a pallet.

When one wishes to undertake a drawing, the displacement of the bar is controlled in the inverse direction so as to recreate groove 12 and enable the pallet to be captured.

As soon as the presence of a pallet is noted, in the manner described, the signal emanating from it is used to control the stopping of the blowing mechanism producing the air current inside the sphere. The pallets, since they no longer receive any energy, all fall to the base of the sphere with the exception of the captured pallet, which can no longer be bumped against by the others.

This application is related to French Application No. 92 01917, filed Feb. 20, 1992, priority of which is claimed, whose disclosure is hereby incorporated by reference thereto in its entirety.

Although the invention has been described with reference to particular means, materials and embodiments, it is to be understood that the invention is not limited to the particulars disclosed and extends to all equivalents within the scope of the claims.

What is claimed is:

1. Apparatus for arbitrary drawing of planar objects comprising:

a receptacle in which an air current can be created;

means for introducing planar objects into said receptacle, said planar objects comprising two opposite faces each having a reproduction of a picture;

means for capturing a planar object in an arbitrary manner, said means for capturing including, on a front portion of said receptacle, a first groove having a trapezoidal section whose width decreases from an upper portion to a lower portion; and means for extracting a captured planar object from said receptacle.

2. The apparatus as defined by claim 1, wherein said lower portion of said first groove extends beyond an outer surface of said receptacle to define a space for passage of a planar object.

3. The apparatus as defined by claim 2, further comprising a second groove having a base and a retractable bar, wherein said space is blocked by said retractable bar to form the base of said second groove in which the lower portion of a planar object can be engaged.

4. The apparatus as defined by claim 3, further comprising means for detecting the presence of a planar object in said second groove.

5. The apparatus as defined by claim 3, further comprising means for delaying the drawing.

6. The apparatus as defined by claim 5, wherein said means for delaying the drawing comprise a retractable bar displacable so as to block said second groove.

7. The apparatus as defined by claim 6, further comprising means for stopping flow of air current following detection of a planar object in said second groove.

8. The apparatus as defined by claim 1, further comprising means for protecting the captured planar object.

9. The apparatus as defined by claim 8, further comprising means for controlling placement of said means for protecting the captured planar object.

10. The apparatus as defined by claim 1, wherein said receptacle comprises an opening at a lower portion, and further comprising a base, supporting said receptacle, having a curved, central portion partially penetrating into said receptacle, said central portion having a periphery including an opening for flow of air.

11. The apparatus as defined by claim 1, wherein said receptacle is spherically shaped.

12. The apparatus as defined by claim 1, wherein said means for introducing planar objects into said receptacle comprise a plurality of substantially vertical grooves.

13. The apparatus as defined by claim 12, wherein said means for introducing planar objects into said receptacle further comprise a retractable trap.

14. The apparatus as defined by claim 1, further comprising a plurality of planar objects.

15. Apparatus for arbitrary drawing of planar objects comprising:

a receptacle in which an air current can be created;

means for introducing planar objects into said receptacle, said planar objects comprising two opposite faces each having a reproduction of a picture;

means for capturing a planar object in an arbitrary manner, said means for capturing including a first groove on a front portion of said receptacle;

means for protecting the captured planar object comprising at least one finger capable of projecting into said first groove, when a planar object is captured, to avoid the captured planar object from being hit by other planar objects moving in said receptacle; and means for extracting a captured planar object from said receptacle.

16. The apparatus as defined by claim 15, wherein said first groove has a trapezoidal section whose width decreases from an upper portion to a lower portion.

17. The apparatus as defined by claim 15, comprising a rotatable shaft, located outside said receptacle, wherein said at least one finger is carried by said rotatable shaft, rotation of said shaft being capable of making said at least one finger project into the first groove through at least one slot.

18. Process for arbitrary drawing of planar objects comprising placing a plurality of planar objects into a receptacle, producing an air current in the receptacle to move the planar objects within the receptacle, capturing a planar object in a groove in said receptacle, protecting the captured planar object by projecting at least one finger into the receptacle above the captured planar object to avoid the captured planar object from being hit by other planar objects moving in the receptacle, and removing the captured planar object from the receptacle.

19. The process as defined by claim 18, comprising stopping the air current after a planar object is captured.

20. Process for arbitrary drawing of planar objects comprising placing a plurality of planar objects into a receptacle comprising a groove, producing an air current in the receptacle to move the planar objects within the receptacle, delaying the capture of a planar object by displacing a retractable bar to block the groove to prevent capturing of a planar object, capturing a planar object in a groove in said receptacle, and removing the captured planar object from the receptacle.

21. The process as defined by claim 18, wherein the receptacle is spherically shaped.

22. The process as defined by claim 20, comprising protecting the captured planar object by projecting at least one finger into the receptacle above the captured planar object to avoid the captured planar object from being hit by other planar objects moving in the receptacle.

* * * * *